US005218267A

United States Patent [19]

Ragland, Jr.

[11] Patent Number: 5,218,267

[45] Date of Patent: Jun. 8, 1993

[54] COLOR PICTURE TUBE WITH SHADOW MASK-FRAME ASSEMBLY

[75] Inventor: Frank R. Ragland, Jr., Lancaster, Pa.

[73] Assignee: Thomson Consumer Electronics, Inc., Indianapolis, Ind.

[21] Appl. No.: 978,294

[22] Filed: Nov. 17, 1992

Related U.S. Application Data

[63] Continuation-in-part of Ser. No. 796,958, Nov. 22, 1991, abandoned.

[51] Int. Cl.[5] ..... H01J 29/07

[52] U.S. Cl. ..... 313/407; 313/406

[58] Field of Search ..... 313/404, 406, 407

[56] References Cited

U.S. PATENT DOCUMENTS

| | | | |
|---|---|---|---|
| 3,516,147 | 6/1970 | Seedorff et al. | 313/407 X |
| 4,723,088 | 2/1988 | Sone et al. | 313/404 |
| 4,728,853 | 3/1988 | Sone et al. | 313/406 |
| 5,021,707 | 6/1991 | Bauder | 313/402 |
| 5,072,151 | 12/1991 | Spina | 313/407 |

FOREIGN PATENT DOCUMENTS

| | | | |
|---|---|---|---|
| 988141 | 4/1976 | Canada | 313/407 |

*Primary Examiner*—Palmer C. Demeo

*Attorney, Agent, or Firm*—Joseph S. Tripoli; Dennis H. Irlbeck

[57] ABSTRACT

An improved color picture tube includes an evacuated envelope having a rectangular faceplate panel. The panel includes a viewing screen on an inner surface thereof and a shadow mask assembly mounted therein by support means located at the four corners of the panel. The shadow mask assembly includes an apertured shadow mask and a peripheral frame to which the mask is attached. The frame is formed by four sections that are welded together at their ends. Two of the sections are longer than the other two sections and are constructed of a material having a different coefficient of thermal expansion than that of the other two sections. The frame reduces electron beam misregister with elements of the screen.

3 Claims, 2 Drawing Sheets

COLOR PICTURE TUBE WITH SHADOW MASK-FRAME ASSEMBLY

This is a continuation-in-part of application Ser. No. 07/796,958, filed Nov. 22, 1991, now abandoned.

This invention relates to color picture tubes of the type having shadow masks attached to peripheral frames that are suspended in relation to cathodoluminescent screens, and particularly to an improved frame which cooperates with corner supports to reduce electron beam misregister with elements of the screen.

BACKGROUND OF THE INVENTION

It is common to use either three or four springs to support a shadow mask within a rectangular faceplate panel of a color picture tube. In a three spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the shadow mask to slightly twist and shift relative to the faceplate during manufacture and tube operation.

One means for minimizing twisting and shifting of a shadow-mask uses spring supports located at the four corners of the frame. Embodiments for achieving such corner support are shown in U.S. Pat. No. 4,723,088, issued to Sone et al. on Feb. 2, 1988, and in U.S. Pat. No. 4,728,853, issued to Sone et al. on Mar. 2, 1988.

An improvement in tubes having corner supports is disclosed in U.S. Pat. No. 5,021,707, issued to Bauder on Jun. 4, 1991. Unlike previous tubes, which aligned the springs and support studs with the tube faceplate panel diagonals, the Bauder patent discloses aligning the springs and studs off of the diagonals so that the support axes form an angle of 33 to 50 degrees with the major axis of the panel. The purpose of offsetting the axes of the supports from the diagonals is to improve the resistance of the supports to shock.

A problem is encountered with having the support axes offset from the diagonals. This problem occurs when the maskframe assembly and support means heat up, and the expansion of the assembly causes the support springs to re-seat on the studs. The problem is especially severe during tube processing, when the temperature of the tube can reach approximately 450° C. Because such re-seating may cause an electron beam misregister, it is desirable to solve the problem. The present invention provides such a solution.

SUMMARY OF THE INVENTION

An improved color picture tube includes an evacuated envelope having a rectangular faceplate panel. The panel includes a viewing screen on an inner surface thereof and a shadow mask assembly mounted therein by support means that are located at the four corners of the panel. The shadow mask assembly includes an apertured shadow mask and a peripheral frame to which the mask is attached. The frame is formed by four sections that are welded together at their ends. Two of the sections are longer than the other two sections and are constructed of a material having a different coefficient of thermal expansion than that of the other two sections.

DETAILED DESCRIPTION OF THE PREFERRED EMBODIMENTS

Figure 1:
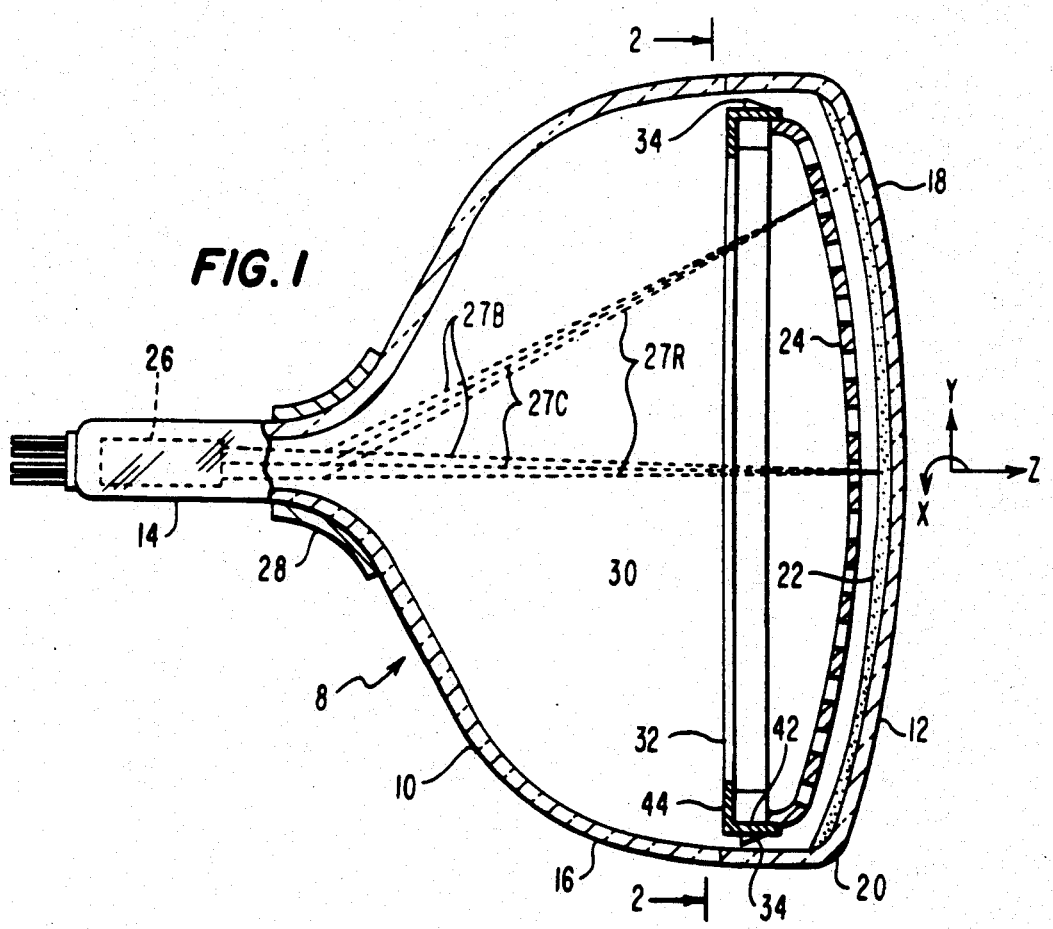
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X, parallel to its wider dimension (usually horizontal), and a minor axis Y, parallel to its narrower dimension (usually vertical). The major and minor axes are perpendicular to a central longitudinal axis Z of the tube, which passes through both the center of the neck 14 and the center of the panel 12. In the preferred embodiment, the panel 12 has a 16×9 aspect ratio. A mosaic three-color phosphor screen 22 is located on the inner surface of the faceplate 18. The screen preferably is a line screen, with the phosphor lines extending substantially parallel to the minor axis Y. Alternatively, the screen may be a dot screen. A multiapertured color selection electrode or shadow mask 24 is removably mounted in predetermined spaced relation to the screen 22. An electron gun 26 is centrally mounted within the neck 14, to generate and direct three electron beams, 27B, 27G and 27R, along convergent paths through the mask 24 to the screen 22.

The tube of FIG. 1 is designed to be used with an external magnetic deflection yoke 28 located in the vicinity of the funnel-to-neck junction. When activated, the yoke 28 subjects the three electron beams to magnetic fields which cause the beams to scan horizontally and vertically in a rectangular raster over the screen 22.

Figure 2:
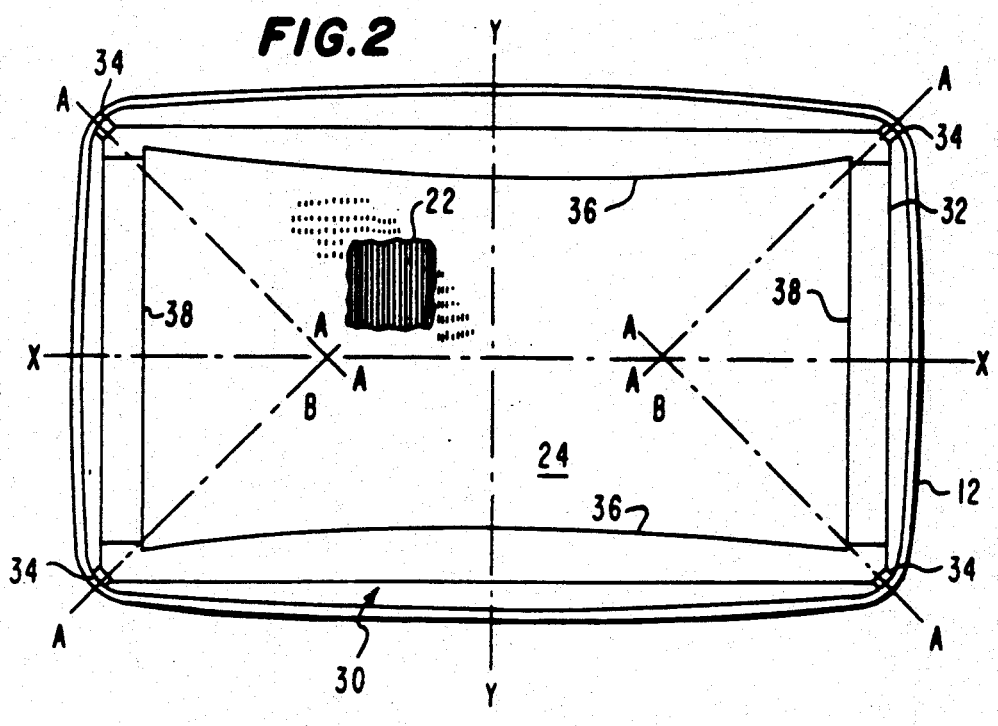
FIG. 2 is a plan view of the back of the faceplate panel and mask-frame assembly, taken at line 2—2 of FIG. 1.

The shadow mask 24 is part of a mask-frame assembly 30 that also includes a novel peripheral frame 32. The mask-frame assembly 30 is shown positioned within the faceplate panel 12 in FIG. 1. As shown in FIG. 2, the mask-frame assembly 30 is mounted to the panel 12 by four support means 34 positioned at the four corners of the assembly. Each support means 34 includes a stud, embedded in the panel sidewall 20, and a spring, attached to a plate that is welded to the frame 32, which engages the stud.

The novel mask frame 32 is formed from four sections: two long sections 36, and two short sections 38. The frame 32 includes two substantially perpendicular flanges in an L-shaped cross-sectional configuration. A first flange 42 extends from the intersection of the flanges in a direction toward the screen 22. A second flange 44 extends inwardly from the intersection of the flanges in a direction toward the central longitudinal axis Z of the tube 8. The four corners of the frame 32 are truncated, being angled relative to the sides of the frame.

Figure 3:
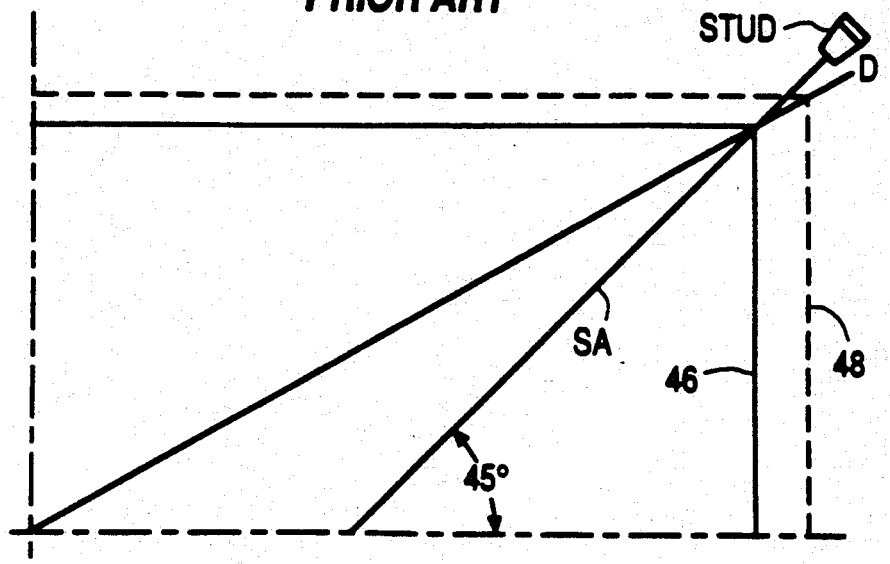
FIG. 3 PRIOR ART
FIG. 3 is a schematic view of a quadrant of a prior art shadow mask frame, showing its thermal expansion.

The frame 32 is improved by constructing the two long sections 36 from a material having a different coefficient of thermal expansion than that of the two short sections 38. Preferably, the two long sections 36 are made from a material having a lower coefficient of thermal expansion than that of the two short sides 38. The purpose of constructing the frame 32 of different materials can be appreciated by comparing FIGS. 3 and 4. FIG. 3 shows the expansion characteristics of a prior frame having all sections formed from the same material. The solid line 46 indicates the frame perimeter before it is heated, and the dashed line 48 indicates the frame perimeter after it has been heated, such as during tube operation or processing. The line D indicates the diagonal of the frame, and the line SA indicates the axis of the mask support means, e.g., the spring and stud. As can be seen, the axis of the support means forms an angle of 45 degrees with the major axis X of the frame, but expansion of the frame causes the corner of the frame to expand along the diagonal D. This difference results in a lateral shift of the corner of the frame relative to the line SA. Such relative lateral movement causes the spring, which is seated on the stud, to twist and re-seat on the stud and set up stresses in the support means. The re-setting often causes a shift of the mask-frame assembly, resulting in a shift of the mask apertures with respect to the screen elements, and causing electron beam misregister.

Figure 4:
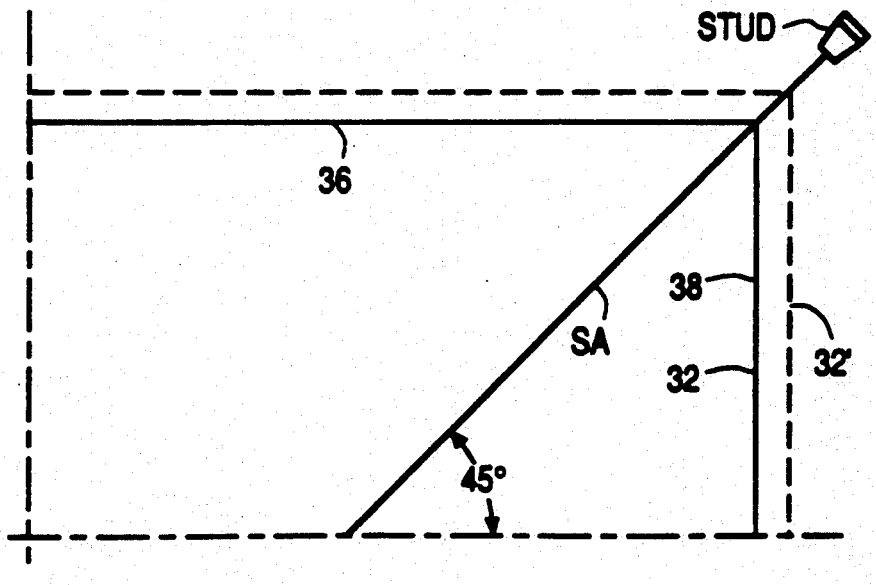
FIG. 4 is a schematic view of a quadrant of the shadow mask frame of the tube of FIG. 1, showing its thermal expansion.

In a tube constructed in accordance with the present invention, both twisting and re-seating of the spring on the stud and stress build-up are prevented by proper selection of the materials used to make the frame. By selecting materials for the frame sections 36 and 38 that will cause the frame corners to expand by substantially equal amounts in both the X-axis and Y-axis directions, during tube warmup to its final operating temperature and during tube processing, the corners of the frame 32 will expand directly along the 45-degree lines of the support means axes SA. This motion, for a corner of the frame, is shown in FIG. 4. In FIG. 4, solid line 32 indicates the perimeter of the novel frame when it is cold, and dashed line 32' indicates the perimeter of the novel frame when it is at final operating temperature.

As an illustrative example, consider a tube having a $16\times9$ aspect ratio and 45-degree angles between the support axes SA and the major axis X. If the long sections 36 are made of ARMCO 18 SR stainless steel (made by ARMCO, Stainless Steel Division, Baltimore, MD, U.S.A), their coefficient of thermal expansion is $10.6\times10^{-6}\ \Delta L/L/°C$. If, then, the short sections 38 are made of NITRONIC 32 stainless steel (also made by ARMCO), the coefficient of thermal expansion of the short sides 38 will be $18.5\times10^{-6}\ \Delta L/L/°C.$, or about 16/9 multiplied times the coefficient of thermal expansion of the long sides. This would ensure that the corners of the mask track the support axes and allow for expansion of the tube glass.

The 45-degree lines in FIGS. 2 and 4 are only illustrative of one of many support axes angles, offset from the diagonal, that may be used. When other support axes are used, a proper selection of materials can be made for the frame sections 36 and 38 that will allow the corners of the frame to track these axes as the mask-frame assembly expands.

Although the frame 32 is shown to be of a planar type, the present invention can be applied to any frame geometry, such as barrel or bowed. Furthermore, although the present invention has been described with respect to a tube having a $16\times9$ aspect ratio, the invention may be applied to tubes having other aspect ratios, including $4\times3$.

What is claimed is:

1. In a color picture tube including an evacuated envelope having a rectangular faceplate panel, said panel including a viewing screen on an inner surface thereof and a shadow mask-frame assembly mounted therein by support means located at the four corners of said panel, said shadow mask-frame assembly including an apertured shadow mask and a peripheral frame to which said mask is attached, and said support means being attached to the corners of said frame, the improvement comprising said frame being formed by four sections that are welded together at their ends, two of said sections being longer than the other two sections and being of a material having a different coefficient of thermal expansion than the other two sections.

2. The tube as defined in claim 1, wherein said long sides of said frame are constructed from a material having a lower coefficient of thermal expansion than that of said short sides.

3. In a color picture tube including an evacuated glass envelope having a rectangular faceplate panel with two long sides and two short sides, said panel including a major axis paralleling said long sides, a minor axis paralleling said short sides, two diagonals extending between opposing corners of said panel and a central longitudinal axis passing perpendicularly through the intersection of said major and minor axes and said diagonals, said panel including a viewing screen on an inner surface thereof and a shadow mask-frame assembly mounted therein by support means located at the four corners of said panel, said shadow mask-frame assembly including an apertured shadow mask and a peripheral frame to which said mask is attached, said frame including two opposing long sides that substantially parallel said major axis, two opposing short sides that substantially parallel said minor axis and corner portions that are acutely angled to both the long and short sides and are approximately perpendicular to the panel diagonals, and said support means being located at the corners of said frame, the improvement comprising said long sides of said frame being constructed from a material having a lower coefficient of thermal expansion than that of said short sides.

* * * * *